United States Patent [19]

Kane et al.

[11] Patent Number: 4,486,020

[45] Date of Patent: Dec. 4, 1984

[54] GOLFER'S PRACTICE SWING DEVICE

[76] Inventors: Brian T. Kane, 1602-2024 Fullerton Ave., North Vancouver, B.C., Canada, V7V 3G4; Richard J. Munn, 4968 Lakeshore Rd., Kelowna, B.C., Canada, V1Y MR3

[21] Appl. No.: 478,671

[22] Filed: Mar. 25, 1983

[30] Foreign Application Priority Data

Nov. 8, 1982 [CA] Canada ..... 415109

[51] Int. Cl.[3] ..... A63B 69/36

[52] U.S. Cl. ..... 273/191 R

[58] Field of Search ..... 273/191 R, 191 B, 192, 273/186 R, 186 A, 191 A

[56] References Cited

U.S. PATENT DOCUMENTS 3,400,933 9/1968 Heiser ..... 273/191 R X 3,429,571 2/1969 Abel ..... 273/191 R X 3,604,712 9/1971 Albro et al. ..... 273/191 R

*Primary Examiner*—George J. Marlo

*Attorney, Agent, or Firm*—Sixbey, Friedman & Leedom

[57] ABSTRACT

A golfer's practice swing device comprising a releasable wall mountable attachment means, a rigid elongated rod secured thereto to swivel freely, and a clamp to releasably receive the shaft of a golf club of a user. The clamp is secured to the free end of the rod for pivotal movement of the clamp and golf club shaft with respect to the rod about an axis parallel and near to that of the golf club shaft. The length of the rod is such that for a predetermined positioning of the attachment means on the wall, the shaft of the golf club will be held in a proper swing plane when the device is in use. The device is portable, simple to construct and may be used on any wall surface. It controls the plane, path and direction of a golfer's swing and ensures a proper swing path of the head of the golf club.

13 Claims, 15 Drawing Figures

I FIG. 6h

GOLFER'S PRACTICE SWING DEVICE

BACKGROUND OF THE INVENTION

The present invention relates to a golfer's practice swing device, and more particularly to a rigid rod type of mechanism, securable to the shaft of a golf club, for controlling the plane path, direction and radius of the golf swing arc of a user of the device.

Many devices have been previously developed intended for use by a student or regular golfer, to assist in improving his or her golf swing. Such devices generally have attempted to train the golfer to swing a particular club in a regular, proper fashion. To more readily appreciate the significant improvements and advantages which are believed to exist in applicant's invention over such prior art devices and to understand the manner in which the present invention differs, some of the theory behind a proper golf swing is believed to be useful.

Modern day theory of what is a "proper" golf swing imagines a large spoked wheel about a golfer as he or she addresses the ball, the hub or axis of the wheel being at the base of the golfer's neck and the lowest portion of the rim being at the ball. The golfer moves the club away, in the upswing, by turning his upper mass around the hub, keep the shaft more or less in the plane of that wheel with the head of the club following the rim of that wheel. At the top of the swing however, there is properly a slight shift in the path of the club head as it commences its downswing, brought about as golfer initiates the movement with his lower mass and keeps his upper mass movement passive. This causes the club head to return the downswing in an arc which is, for an average male golfer, at about an angle of 12° inside the arc which the club head followed towards the end of the upswing, the shaft still however lying more or less in the plane of the imaginary spoked wheel. The head of the club, towards the lower part of the downswing as it approaches the ball, returns to a path approximately coincident with the arc-like path followed by the club head in the upswing. The change of path which the club head makes at the top of the backswing is called the "loop". Golf instructors feel that this "loop" of the swing is necessary to ensure not only that the face of the club hits the ball squarely, but also that the face of the club hits the ball on the target line towards the desired target towards which the ball is hit. (See for example article entitled "How To Slow Down Your Swing", "Golf Digest", June 1984, page 42 and article entitled "Feel The Wheel For Proper Plane" by Lou Skovran in "Golf Magazine", Nov. 1981, at page 54).

Another essential element of a proper golf swing is that of the crossover of hands (see article entitled "Crossover" by Harry Obitz in "Golf Magazine", Oct. 1982, at pages 32 and 33). For a right-handed golfer, in all good swings, the left hand must cross, or climb, over the right hand (pronation) as the player swings back. This motion occurs because the right arm folds on the back swing and the shaft of the golf club rotates to the right following the turn of the body. In the forward or downward swing, it reverses: the right hand crosses over the left as the shaft and body rotate to the left. "Crossover" is important because of the effect it has on the face of the head or blade of the club at impact with the ball. Assuming basic fundamentals, if the crossover is made prematurely in the forward swing, so that, at impact, the right hand is already crossed over the left, the blade of the club will be closed and a "hook" will result in the golf ball's trajectory. If the crossover is late, the blade will be open and a "slice" will result. Thus, to achieve proper pronation and supination, or as the result thereof, the club shaft must rotate to the right on the upswing and to the left on the downswing.

Golfer's swing practice devices which have been heretofore developed incorporate many different constructions. For example, one type requires no attachment to the golf club of the user. Instead it comprises tracts or guides, against which a part of the golf club is to bear during the swinging of the golf club by the user, to thereby control the orientation and position of the golf club when it is being swung. An example of such a device is found in Canadian Pat. No. 518,637 of Plunkett issued Nov. 15, 1955.

In another type, the device is in some way attached to a part of the golf club. Included in this type are those in which a flexible member such as a line or rope are anchored to an immovable object at one end and secured to a part of the golf club at the other (see for example U.S. Pat. Nos. 2,455,707 issued Dec. 7,1948 of Sheffer, 2,655,378 issued Oct. 13, 1953 of Sheffer; 2,788,214 issued Apr. 9, 1957 of Tilden and Canadian Pat. No. 872,391 issued June 1, 1971 of Gentry). Moller U.S. Pat. No. 3,738,661 issued June 12, 1973 describes and illustrates a golf exercising device comprising an anchored arm which is free to rotate about one axis and has a lower, flexible section. These practice devices having flexible lines or arms are not intended to train a golfer on proper crossover techniques during the golf swing; nor do they hold the club head in proper alignment on the target line with the respect to the ball. In this regard they permit the swing path to drift outside the target line (away from the golfer) a condition which in fact produces a slice.

Another kind of swing practice device which is secured to a portion of a golf club or practice handle is that which is made up of an articulated or rigid rod, anchored at one end and secured to the golf device at the other. Typical of such devices are those described and illustrated in Richards U.S. Pat. No. 4,261,573 issued Apr. 14, 1981, Jenks U.S. Pat. No. 2,626,151 issued Jan. 20, 1953, Cottingham U.S. Pat. No. 2,472,065 issued June 7, 1949 and Hetman et al Canadian Pat. No. 911,478 issued Oct. 3, 1972. Such devices have tended to be extremely complicated, requiring expensive, precisely manufactured and fitting mechanical hinges which among other things tend to bind. Because of their very complexity, many of these devices do not lend themselves to adaption to different sizes and frames of users and may require major mechanical alterations for users having different strength. They usually require expensive anchor stands or permanent anchor wall fixtures which cannot easily be repositioned or relocated. Such devices also tend to allow motion of the user's club face towards the ball, during a practice swing, such that the club face is not maintained on a swing path inside or on the target line. (One of the most prevalent problems a golfer faces is permitting the path of his club face on the downswing to go outside the target line, away from his body, resulting in a slice.)

Another background reference of interest is Garten U.S. Pat. No. 3,614,108 issued Oct. 19, 1971. This reference describes and illustrates a rigid rod secured at one end to a plate more or less permanently secured to a wall, the rod rotating as if on a fixed, truncated conical surface. A simulated golf club handle is affixed to the other end of the arm. Such device, while relatively simple, cannot provide for the required loop action at the top of the swing, with the result that the rod brings the user outside of the target line on the downswing. As well, such device does allow for pronation and supination of the hands of the user.

It is thus an object of the present invention to provide a simple, inexpensive golf practice swing device which will hold the swing of the user into a relatively accurate swing pattern and prevent the user from developing a swing path which drifts outside of the target line. It is a further object of the present invention to provide such a device which will at the same time urge proper pronation and supination of the golfer's arms during practice. It is a further object of the present invention to provide such a golf swing device which may be used in a variety of locations and which will work properly for a wide variety of frames, sizes and strengths of golfers.

SUMMARY OF THE INVENTION

According to the present invention there is provided a golfer's swing practice device comprising a releasably securable attachment means for a vertical surface and a rigid elongated rod. A connection means is associated with the attachment means to mechanically connect the attachment means to one end of the rod and enable the rod to swivel freely with respect to the attachment means but with no axial movement. Clamp means are provided to releasably receive the shaft of a golf club or practice handle and grip a portion of the shaft and secure it against unpurposeful disengagement. Connection means is associated with the clamp means and has a receptacle for receiving and mechanically connecting the other end of the rod to the clamp, with no relative axial movement with respect to the rod, this other end of the rod being at an angle with respect to the rest of the rod and to fit into the receptacle in a manner to permit pivotal movement of the clamp means and the shaft with respect to the rod about an axis parallel and near to that of the shaft. The length of the rod is such that, for a predetermined positioning of the attachment means on the vertical surface, the shaft when the device is in use will be guided towards a proper swing plane and will be turned a required amount for pronation and supination and the head of the club will be guided towards a proper swing path.

In a preferred embodiment, the attachment means comprises a suction cup for gripping the surface of a wall for securing the device thereto at a selected position against unpurposeful movement or disengagement.

The golfer's swing practice device according to the present invention is relatively inexpensive and simple to construct, readily portable and extremely easy to set up and easy and effective in use. It promotes a swing which is virtually the same each time for a particular club, and in a proper plane, the club face being held within or along the target line at all times.

BRIEF DESCRIPTION OF THE DRAWINGS

These and other objects and advantages of the invention will become apparent upon reading the following detailed description and upon referring to the drawings in which.

Figure 7:
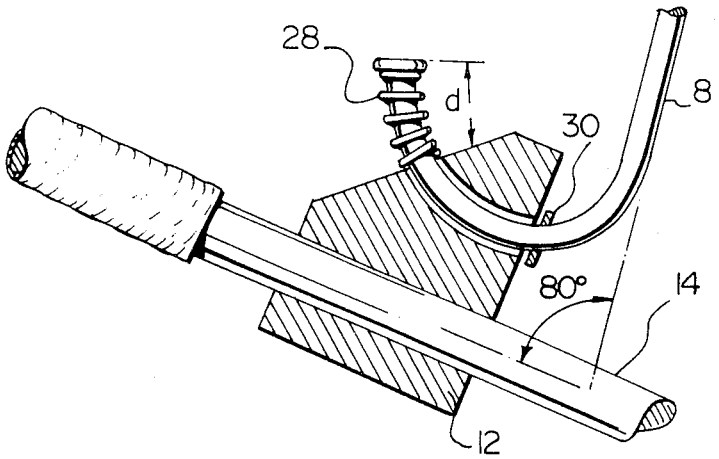

FIG. *6a*, *6b*, *6c*, *6d*, *6e*, *6f*, *6g*, *6h* and *6i* are schematic views of a user at various stages of a swing using the practice device according to the present invention;

FIG. 7 is a partial view of an alternative embodiment of the golfer's swing practice device according to the present invention.

While the invention will be described in connection with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Figure 2:
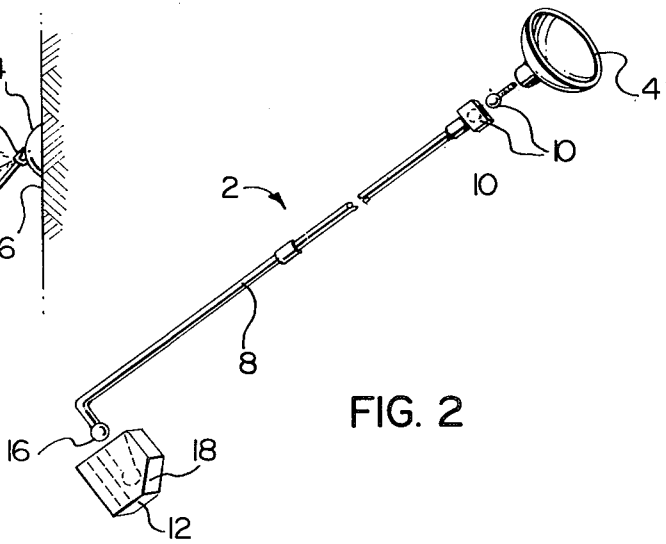
FIG. 2 is an exploded view of the golf swing practice device of FIG. 1.
Figure 1:
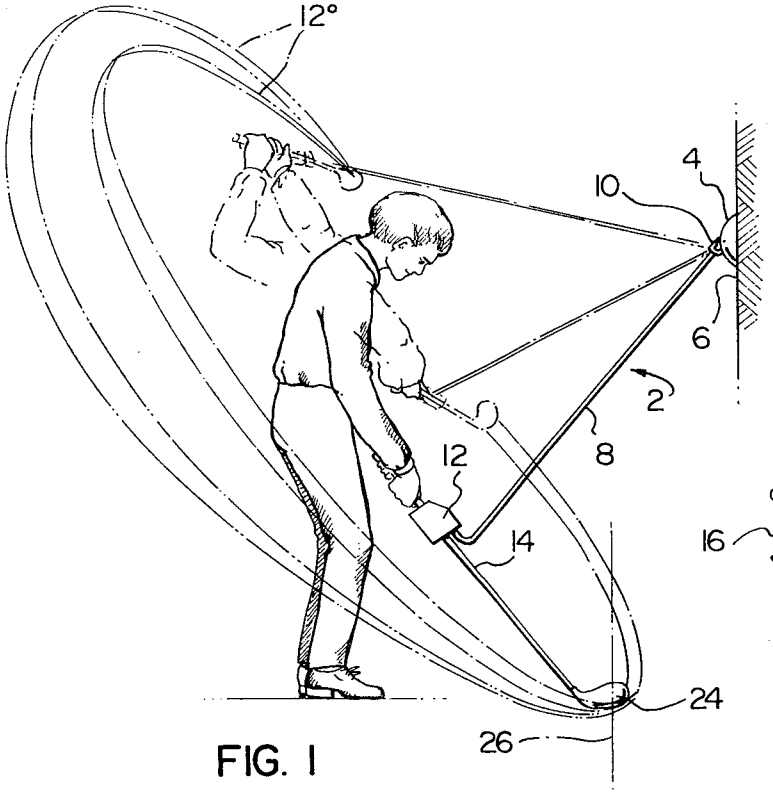
FIG. 1 is an example embodiment of a golfer's swing practice device according to the present invention illustrating certain theoretical aspects of a golf swing in the light of the present invention.
Figure 4:
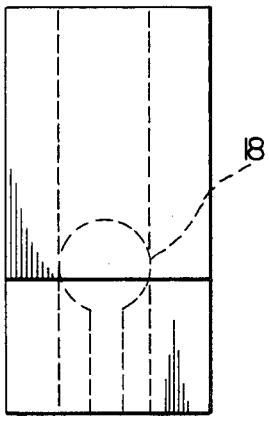
FIGS. 4 and 5 are respectively end and side views of the clamp illustrated in FIG. 3.
Figure 5:
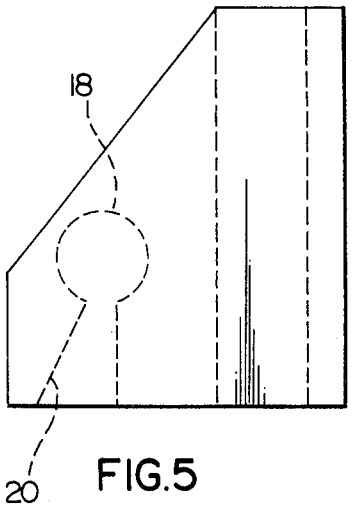
Figure 3:
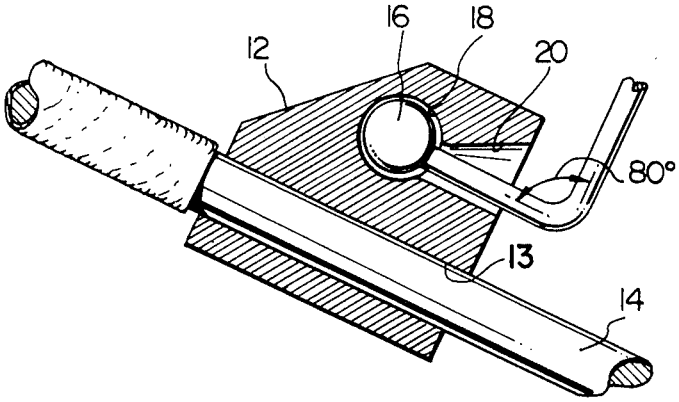
FIG. 3 is a partial view of a golf club shaft with a clamp according to the present invention, shown in section, secured thereto.

Turning to FIGS. 1 and 2 there is shown an example embodiment of a golfer's swing practice device 2 according to the present invention. The device comprises an attachment means 4, shown to be a flexible suction cup, to be releasably secured to a vertical surface such as a wall 6. As will be described in more detail hereinafter, it is important to locate the attachment means at a proper height and orientation with respect to the user for proper operation of the device. A rigid elongated rod 8 is secured to the suction cup 4 by means of ball and socket joint 10 so that rod 8 may swivel in any direction with respect to the suction cup. Clamp 12 releasably receives the shaft 14 of a golf club of the user, and grips the portion of the shaft immediately below the handle to secure the shaft at that point against unpurposeful disengagement. The end of rod 8 nearest clamp 12 is bent, preferably to about an 80° angle to the main body of the rod. Ball 16 at the end of rod 8 is pivotally received in socket 18 of clamp 12 for pivotal movement of the clamp 12 and club shaft 14 with respect to rod 8 about an axis parallel to that of the club shaft. As will be described in more detail hereinafter, this pivotal motion approximates that required for proper pronation and supination of the hands during the golfer's swing. As well, as can be seen in detailed FIGS. 3, 4 and 5, a bevelled channel surface 20 is provided remote from the clamp channel 13 which receives shaft 14, to permit limited pivotal movement of the clamp and shaft about an axis which, in operation, is in the swing plane (FIG. 1) and normal to the axis of the club shaft 14. It is this feature, as will be described in more detail hereinafter, which permits the user of the device to move the club at the top of the back swing to form the loop of the swing.

The golf swing practice device 2 according to the present invention may be alternatively attached to a practice handle 15 (FIGS. *6a* to *6i*) by clamp 12, instead of to a golf club, if desired.

It is important, in constructing the device according to the present invention, that the length of the rod 8 between ball and socket joint 10 and clamp 12 is such that, for a selected positioning of the suction cup attachment means on a wall at, preferably about eye level of the user, the shaft 14 of the golf club when in use will be guided to a proper swing plane and will be turned a proper amount for pronation as supination of the club. In this regard, it will be observed that the rod 8, during the swing of the golfer, will trace out more or less the surface of a right-angled cone having a circular base in the swing plane of the golf club and a center, in that circular base, being the "hub" of the spoked wheel previously referred to in the theory discussion on a proper golf swing. Rod 8 thus exerts control in several ways on the user in carrying out his golf swing: firstly, it exerts control of the plane and position of the golf club, secondly it exerts control on the radius of the golf swing and thirdly, because of the relationship between rod 8 and clamp 12, it exerts control on the rotation of the shaft of the golf club for proper pronation and supination. The rod thereby controls the plane, path and direction of the golf swing as well as the radius of the golf swing arc. The hinge clamp allows the freedom to pronate and supinate and "loop" at the top of the swing.

The use the practice swing device according to the present invention, suction cup 4 must be placed in a correct position for the user's physique. The suction cup 4 is essentially placed on a smooth surface at eye level, with the user standing erect to establish eye level position. (The attachment of suction cup 4 on that surface must be such that the suction cup will not become dislodged or removed from that position during normal operation of the practice device 2).

Figure 6A:
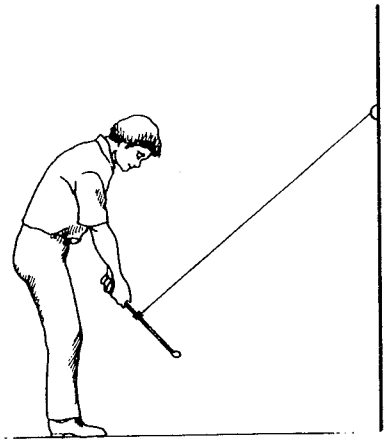
Figure 6B:
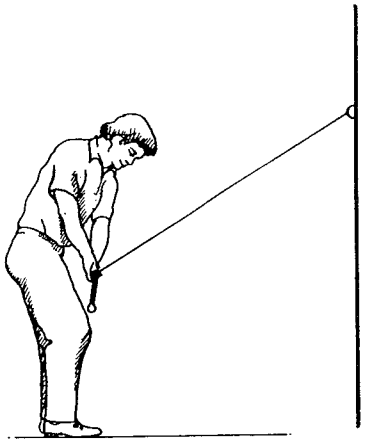
Figure 6C:
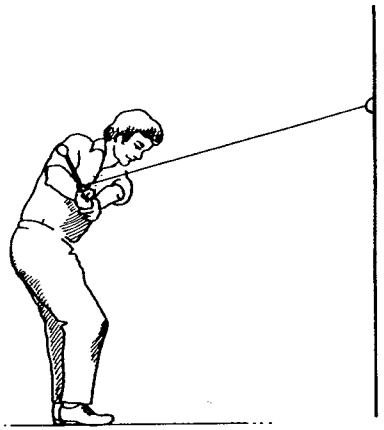
Figure 6D:
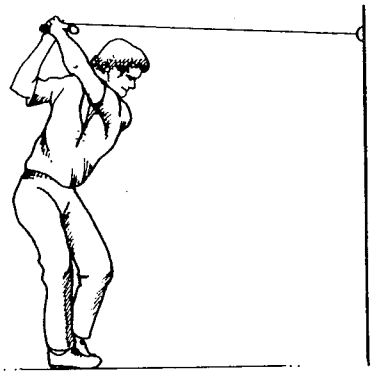
Figure 6E:
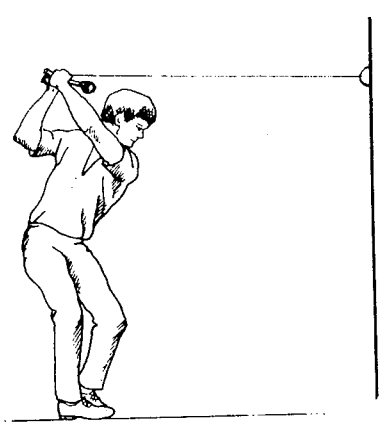
Figure 6F:
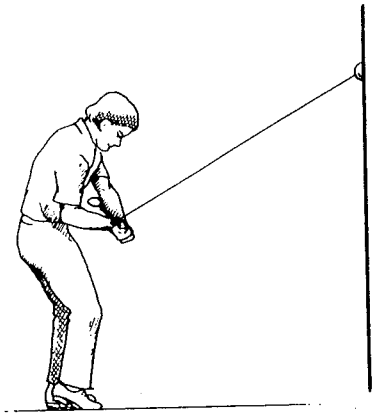
Figure 6G:
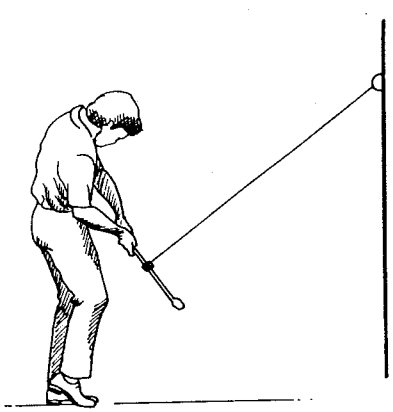
Figure 6I:
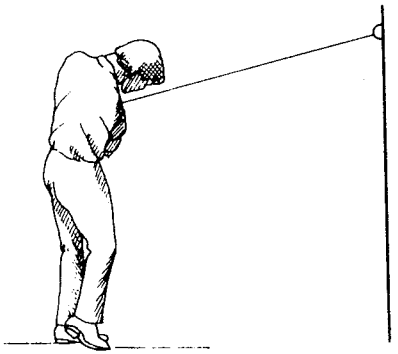
Figure 6I:
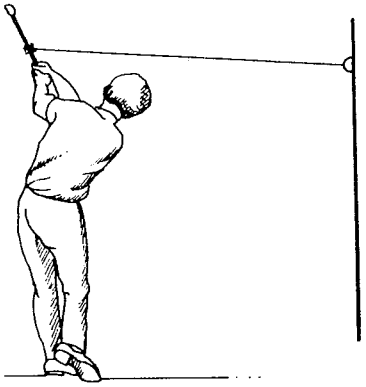

The rod 8, properly secured to clamp 12, with ball 16 in socket 18, and with shaft 14 secured beneath the handle portion of the golf club in channel 13, is ready for use. Clamp 12 may be constructed of any appropriate material and, for example, may be made of an appropriate plastic such as polyurethane. The user's swing movements are illustrated in sequence in FIGS. 6*a* to 6*i*. The device, as a result of bevelled channel surface 20, permits the looping action of the club at the top of the upswing, to ensure that the club head 24 is guided inside the line of target 26 (FIG. 1) on the downswing, into line behind the golf ball to be fit. Pronation on the upswing (FIGS. 6*a* to 6*d*) and supination on the downswing (FIGS. 6*f* and 6*g*) are achieved through axial rotation of the club shaft 14 dictated by the axial rotational action exerted by rod 8 through clamp 12 on shaft 14 as the upswing and downswing take place.

In FIG. 7 an alternative embodiment of the present invention is illustrated, in which the lower end of rod 8 is curved as shown and secured to clamp 12. The action of this embodiment is however similar to that of ball 16 and clamp socket 18. There is limited axial movement of the curved end of rod 12 within clamp 8 along distance "d" with spring 28 urging the rod to normal position with respect to clamp 12 as shown. Stop 30 prevents axial movement of the rod too much in the direction towards spring 28. This axial motion in fact, because of the curve in this end of rod 8, allows a limited pivotal movement approximating that allowed by bevelled channel surface 20 of the clamp of FIGS. 1 to 5. Thus there is not the same controlled rotation of the shaft for pronation and supination according to this embodiment.

Actual use of the device according to the present invention, in testing has shown dramatic results. A person who had never previously golfed in his life was coached by a golf instructor using a device according to the present invention for three hours. He was then brought to a driving range where he hit 100 balls. The first then or so balls were topped. The balance were hit fairly straight but not that well. He was given a further hour of coaching using the device according to the present invention, and the following day he hit 40 balls out of 100 relatively straight and well over 200 yards. The balance of his hits were acceptable. Bearing in mind the subjective nature of such a test, and the face that the student may have had a particular aptitude towards learning a proper golf swing, nevertheless such results from four hours of training are virtually impossible to achieve according to known teaching methods and devices.

Thus there has been provided in accordance with the present invention a golfer's practice swing device that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. A golfer's swing practice device comprising:

(a) a releasably securable attachment means for a vertical surface;

(b) a rigid elongated rod;

(c) connection means associated with the attachment means to mechanically connect the attachment means to one end of the rod and enable the rod to swivel freely with respect to the attachment means, but with no axial movement;

(d) clamp means to releasably receive the shaft of a golf club or practice handle and grip a portion of the shaft to secure it against unpurposeful disengagement;

(e) connection means associated with the clamp means and having a receptacle for receiving and mechanically connecting the other end of the rod to the clamp with no relatively axial movement thereof with respect to the rod, this other end of the rod being at an angle with respect to the rest of the rod and to fit into the receptacle in a manner to permit pivotal movement of the clamp means and the shaft with respect to the rod about an axis parallel and near to that of the shaft, the length of the rod being such that, for a selected positioning of the attachment means on the vertical surface, the shaft when the device is in use will be guided towards a proper swing plane and will be turned a required amount for pronation and supination and the face of the head of the club will be guided towards a proper swing path.

2. A device according to claim 1 wherein the clamp means comprises a body having an elongated channel extending therethrough for releasably receiving the shaft.

3. A device according to claim 2 wherein the connection means associated with the clamp means further comprises means for limited pivotal movement of the clamp and shaft about an axis which is in the swing plane and normal to the shaft.

4. A device according to claim 3 wherein the end of the rod connected to the clamp means is at an angle of about 80° with respect to the remainder of the rod, that end terminating in a ball to be received for pivotal movement in a socket provided in the clamp means.

5. A device according to claim 1 wherein the attachment means comprises a suction cup for gripping the surface of a wall for securing the device thereto at a selected position against unpurposeful movement of disengagement during operation of the device.

6. A device according to claim 5 wherein the attachment means is connected to the rod by way of a ball and socket joint.

7. A golfer's swing practice device comprising:

(a) support means for vertical positioning of the device;

(b) a rigid elongated rod;

(c) first connection means associated with the support means to mechanically connect the support means to a first end of the rod and enable the rod to swivel freely with respect to the support means; and (d) clamp means to releasably receive the shaft of a golf club or practice handle and grip a portion of the shaft to secure it against movement relative to said clamp means, said clamp means including second connection means to mechanically connect the clamp means and a second end portion of the rod to permit pivotal movement of the clamp means and the shaft with respect to the rod, the second end portion of said rod and said second connection means being formed such that the second end portion of said rod extends along an axis substantially parallel to that of the shaft when the shaft is gripped by said clamp means at said second connection means.

8. A device according to claim 7 wherein said rod is formed such that the second end portion thereof extends at an angle of about 80° with respect to the remainder of said rod.

9. A device according to claim 7 wherein said second connection means includes a channel formed in said clamp means to receive the second end portion of said rod.

10. A device according to claim 9 wherein said channel is curved in configuration and wherein said second end portion of said rod is curved to conform to the curve of said channel, said channel and second end portion being configured such that said rod extends at an angle of approximately 80° to the axis of said shaft when the shaft is gripped by said clamp means and the second end portion of said rod is received in said channel.

11. A device according to claim 10 wherein said channel extends through said clamp means, the second end portion of said rod extending through said channel to a terminal end positioned externally of said clamp means, said second end portion being mounted for limited axial movement with said channel.

12. A device according to claim 9 wherein said channel extends inwardly from an opening in said clamp means, said channel having at least one inclined wall to cause said channel to be bevelled inwardly from a wide section adjacent said opening.

13. A device according to claim 12 wherein said second connection means includes a socket formed in said clamp means and a ball for engagement in said socket formed at the end of the second end portion of said rod, said channel terminating at said socket and extending between the socket and said opening, said channel having a first wall portion adjacent to said clamp means which extends substantially parallel to the axis of said shaft when said shaft is gripped by said clamp means and a second wall portion which is spaced outwardly from said first wall portion and which is inclined outwardly from said socket toward said opening.

* * * * *